US008932153B2

(12) United States Patent
Ishii et al.

(10) Patent No.: US 8,932,153 B2
(45) Date of Patent: Jan. 13, 2015

(54) GOLF BALL WITH SPECIFIED CORE COEFFICIENT OF RESTITUTION

(71) Applicant: NIKE, Inc., Beaverton, OR (US)

(72) Inventors: Hideyuki Ishii, Portland, OR (US); Yasushi Ichikawa, Tualatin, OR (US); Arthur Molinari, Portland, OR (US); Jun Ichinose, Tokyo (JP); Chen-Tai Liu, Yun-lin Hsien (TW)

(73) Assignee: NIKE, Inc., Beaverton, OR (US)

( * ) Notice: Subject to any disclaimer, the term of this patent is extended or adjusted under 35 U.S.C. 154(b) by 70 days.

(21) Appl. No.: 13/731,846

(22) Filed: Dec. 31, 2012

(65) Prior Publication Data

US 2013/0210546 A1 Aug. 15, 2013

Related U.S. Application Data

(60) Provisional application No. 61/582,602, filed on Jan. 3, 2012.

(51) Int. Cl.
*A63B 37/04* (2006.01)
*A63B 37/00* (2006.01)

(52) U.S. Cl.
CPC ..... *A63B 37/0041* (2013.01); *A63B 37/0045* (2013.01); *A63B 37/0046* (2013.01); *A63B 37/0051* (2013.01); *A63B 37/0061* (2013.01); *A63B 37/0064* (2013.01); *A63B 37/0065* (2013.01); *A63B 37/0076* (2013.01); *A63B 37/0078* (2013.01)
USPC ..... 473/371

(58) Field of Classification Search
USPC ..... 473/351–378
See application file for complete search history.

(56) References Cited

U.S. PATENT DOCUMENTS

| | | | | |
|---|---|---|---|---|
| 6,852,784 | B2 * | 2/2005 | Sullivan | 524/322 |
| 6,894,098 | B2 * | 5/2005 | Rajagopalan et al. | 524/322 |
| 6,939,907 | B2 * | 9/2005 | Rajagopalan et al. | 524/322 |
| 6,994,638 | B2 * | 2/2006 | Rajagopalan et al. | 473/377 |
| 7,148,279 | B2 * | 12/2006 | Voorheis et al. | 524/394 |
| 7,157,512 | B2 * | 1/2007 | Rajagopalan et al. | 524/322 |
| 7,230,045 | B2 * | 6/2007 | Rajagopalan et al. | 524/322 |
| 7,300,364 | B2 * | 11/2007 | Boehm et al. | 473/376 |
| 7,331,878 | B2 * | 2/2008 | Boehm et al. | 473/376 |
| 7,357,735 | B2 * | 4/2008 | Sullivan et al. | 473/374 |
| 7,365,128 | B2 * | 4/2008 | Sullivan | 525/187 |
| 7,402,629 | B2 * | 7/2008 | Rajagopalan | 525/128 |
| 7,452,289 | B2 * | 11/2008 | Comeau | 473/373 |
| 7,530,908 | B2 * | 5/2009 | Boehm et al. | 473/376 |

(Continued)

OTHER PUBLICATIONS

Notification of Transmittal of the International Search Report and The Written Opinion of the International Searching Authority in connection with International Patent Application No. PCT/US2013/020104 mailed on May 30, 2013; 15 pages.

*Primary Examiner* — Alvin Hunter
(74) *Attorney, Agent, or Firm* — Honigman Miller Schwartz and Cohn LLP; Anna M. Budde; Jonathan P. O'Brien

(57) ABSTRACT

A high performance golf ball includes a resin inner core, a rubber outer core, and a cover. The resin inner core is made of highly neutralized polymer, and may include a blend of different highly neutralized polymers. The cover is a two layer cover, with a hard inner cover and a thermoplastic polyurethane outer cover. The ball as a whole has properties to maximize performance and aesthetic properties, such as feel and sound.

13 Claims, 2 Drawing Sheets

(56) References Cited

U.S. PATENT DOCUMENTS

| | | | | |
|---|---|---|---|---|
| 7,642,319 | B2 * | 1/2010 | Sullivan | 525/190 |
| 7,652,086 | B2 * | 1/2010 | Sullivan et al. | 524/322 |
| 7,988,569 | B2 * | 8/2011 | Sullivan et al. | 473/376 |
| 8,007,375 | B2 * | 8/2011 | Sullivan et al. | 473/374 |
| 8,007,376 | B2 * | 8/2011 | Sullivan et al. | 473/376 |
| 8,057,325 | B2 * | 11/2011 | Dalton et al. | 473/376 |
| 8,079,920 | B2 * | 12/2011 | Sullivan et al. | 473/376 |
| 8,163,823 | B2 * | 4/2012 | Sullivan | 524/247 |
| 8,168,710 | B2 * | 5/2012 | Rajagopalan et al. | 524/322 |
| 8,382,611 | B2 * | 2/2013 | Sullivan et al. | 473/376 |
| 8,556,748 | B2 * | 10/2013 | Sullivan et al. | 473/376 |
| 8,618,197 | B2 * | 12/2013 | Sullivan et al. | 524/322 |
| 8,690,713 | B2 * | 4/2014 | Sullivan et al. | 473/376 |
| 2004/0186210 | A1 | 9/2004 | Sullivan | |
| 2011/0053707 | A1 | 3/2011 | Ishii et al. | |
| 2011/0130220 | A1 | 6/2011 | Ichikawa et al. | |
| 2011/0143863 | A1 | 6/2011 | Sullivan et al. | |
| 2012/0077621 | A1 | 3/2012 | Ishii et al. | |

* cited by examiner

| | Diameter (mm) | Weight (g) | Hardness, Shore D | Density (g/cm^3) | Compression, 10kg-130kg | Compression Difference( inner core minus outer core) | Compression, 0.2kg-5kg | Compression, 0.5kg-30kg | COR131 | COR140 | COR160 | Ball MOI | Ball driver spin @ club head speed 125mph |
|---|---|---|---|---|---|---|---|---|---|---|---|---|---|
| Design1 Inner Core | 24.6 | 8.3 | 50 | 1.056 | 3.75 | 0.7 | 0.524 | 1.5464 | 0.8 | 0.774 | 0.751 | | |
| Comp1 Inner Core | 25 | 9.37 | 48-50D | 1.158 | 4.8 | 1.92 | 0.8237 | 1.9329 | 0.7698 | 0.7522 | 0.7162 | | |
| Comp2 Inner Core | 23.8 | 8.43 | 44-45D | 1.154 | 5.165 | 2.305 | 1.3287 | 2.0511 | 0.745 | 0.721 | 0.692 | | |
| Comp3 Inner Core | 34.01 | 24.3 | 53D | 1.162 | 3 | 0.32 | 0.8617 | 1.47 | 0.7745 | 0.7615 | 0.731 | | |
| | | | | | | | | | | | | | |
| Design1 Outer Core | 38.64 | 33.57 | 57 | 1.101 | 3.05 | | 0.9837 | 1.5521 | 0.8044 | 0.7935 | 0.7675 | | |
| Comp1 Outer Core | 39.42 | 37.6 | 61-62D | 1.16 | 2.88 | | 0.8692 | 1.342 | 0.7986 | 0.7836 | 0.7551 | | |
| Comp2 Outer Core | 38.5 | 35.4 | 54-55D | 1.181 | 2.86 | | 0.9468 | 1.439 | 0.7755 | 0.7587 | 0.727 | | |
| Comp3 Outer Core | 38.27 | 33.88 | 53D | 1.103 | 2.68 | | 0.9692 | 1.4021 | 0.7739 | 0.762 | 0.7327 | | |
| | | | | | | | | | | | | | |
| Design1 Inner Cover | 40.5 | 38.75 | 68 | 1.164 | 2.72 | | 1.0153 | 1.4945 | 0.7975 | 0.7883 | 0.7588 | | |
| Comp1 Inner Cover | 41.17 | 41.45 | 59-60 | 0.974 | 2.59 | | 1.0221 | 1.441 | 0.8012 | 0.788 | 0.761 | | |
| Comp2 Inner Cover | 41.73 | 43.06 | 63 | 0.972 | 2.46 | | 0.9846 | 1.4026 | 0.7897 | 0.7787 | 0.7489 | | |
| Comp3 Inner Cover | 40.69 | 39.58 | 60D | 0.908 | 2.46 | | 1.0212 | 1.4285 | 0.7797 | 0.7644 | 0.7429 | | |
| | | | | | | | | | | | | | |
| Design1 Outer Cover | 42.84 | 45.81 | 56 | 1.141(cover) | 2.53 | | 0.4045 | 0.9939 | 0.783 | 0.7714 | 0.7457 | 83.66 | 2549 |
| Comp1 Outer Cover | 42.75 | 45.83 | 63 | 1.127(cover) | 2.65 | | 0.3538 | 1.0007 | 0.789 | 0.7736 | 0.7496 | 82.23 | 2936 |
| Comp2 Outer Cover | 42.79 | 45.92 | 60-61 | 1.128(cover) | 2.41 | | 0.3996 | 0.8511 | 0.787 | 0.779 | 0.7496 | 81.7 | 3109 |
| Comp3 Outer Cover | 42.71 | 45.67 | 57D | 1.135(cover) | 2.52 | | 0.3762 | 0.9639 | 0.7758 | 0.7633 | 0.7355 | 81.22 | 3383 |

FIG. 2

GOLF BALL WITH SPECIFIED CORE COEFFICIENT OF RESTITUTION

CROSS-REFERENCE TO RELATED APPLICATION

This application claims priority under 35 U.S.C. §119(e) to U.S. Provisional Patent Application No. 61/582,602, entitled "Golf Ball with Specified Core Coefficient of Restitution", and filed on Jan. 3, 2012, which application is hereby incorporated by reference.

BACKGROUND

The present invention relates generally to a golf ball having different play characteristics in different situations.

The game of golf is an increasingly popular sport at both amateur and professional levels. A wide range of technologies related to the manufacture and design of golf balls are known in the art. Such technologies have resulted in golf balls with a variety of play characteristics and durability. For example, some golf balls have a better flight performance than other golf balls. Some golf balls with a good flight performance do not have a good feel when hit with a golf club. Some golf balls with good performance and feel lack durability. Thus, it would be advantageous to make a durable golf ball with a good flight performance that also has a good feel.

SUMMARY

A high performance golf ball includes a resin inner core, a rubber outer core, and a cover. The resin inner core is made of highly neutralized polymer, and may include a blend of different highly neutralized polymers. The cover is a two layer cover, with a hard inner cover and a thermoplastic polyurethane outer cover. The ball as a whole has properties to maximize performance and aesthetic properties, such as feel and sound.

In one aspect, the invention provides a golf ball comprising: an inner core layer comprising a highly neutralized polymer. The inner core layer has a first coefficient of restitution. An outer core layer encloses the inner core layer, wherein the outer core comprises polybutadiene rubber. The outer core layer has a second coefficient of restitution. The outer core layer has a thickness of at least 4.8 mm. The outer core layer has a compression between 2.7 mm and 3.3 mm when measured with an initial load of 10 kg and a final load of 130 kg. An inner cover layer encloses the outer core layer, the inner cover layer comprising urethane. The inner cover layer has a third coefficient of restitution. An outer cover layer encloses the inner cover layer, the outer cover layer comprising thermoplastic polyurethane. The ball as a whole has a ball coefficient of restitution. The second coefficient of restitution is greater than the first coefficient of restitution. The second coefficient of restitution is greater than the third coefficient of restitution. The third coefficient of restitution is greater than the ball coefficient of restitution

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 2 is comparative data collected from a ball made according to the present design and commercially available high performance golf balls.

DETAILED DESCRIPTION

Figure 1:
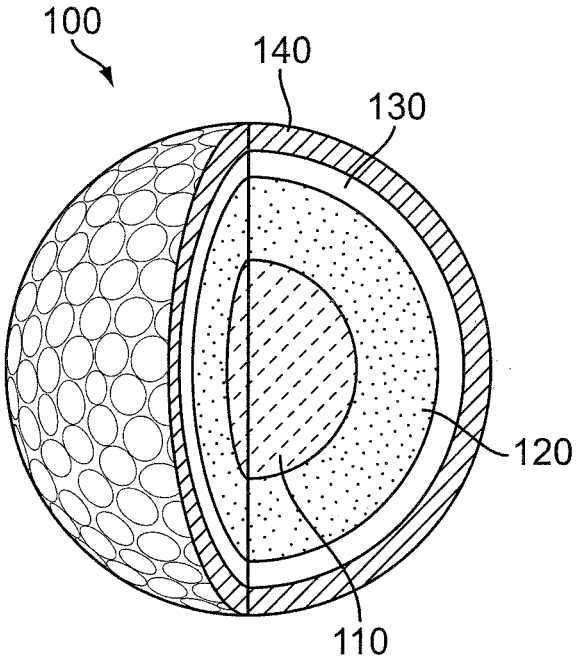
FIG. 1 is an exemplary embodiment of a golf ball with a resin inner core and a rubber outer core.

Generally, the present disclosure relates to a golf ball with a resin inner core and a rubber outer core. While many advantageous performance and feel properties may be found in a golf ball with a resin inner core and a rubber outer core, it is believed by the inventors that the design disclosed herein allows these advantageous performance and feel properties to be more fully realized.

The golf ball may be made by any suitable process. The process of making the golf ball may be selected based on a variety of factors. For example, the process of making the golf ball may be selected based on the type of materials used and/or the number of layers included. Exemplary processes are discussed below with respect to the individual layers of the exemplary embodiment.

As used herein, the term "about" is intended to allow for engineering and manufacturing tolerances, which may vary depending upon the type of material and manufacturing process, but which are generally understood by those in the art. Also, as used herein, unless otherwise stated, compression, hardness, COR, and flexural modulus are measured as follows:

Compression deformation: The compression deformation herein indicates the deformation amount of the ball under a force; specifically, when the force is increased to become 130 kg from 10 kg, the deformation amount of the ball under the force of 130 kg subtracts the deformation amount of the ball under the force of 10 kg to become the compression deformation value of the ball. All of the tests herein are performed using a compression testing machine available from Automated Design Corp. in Illinois, USA. The ADC compression tester can be set to apply a first load and obtain a first deformation amount, and then, after a selected period, apply a second, typically higher load and determine a second deformation amount. Thus, the first load herein is 10 kg, the second load herein is 130 kg, and the compression deformation is the difference between the second deformation and the first deformation. Herein, this distance is reported in millimeters. The compression can be reported as a distance, or as an equivalent to other deformation measurement techniques, such as Atti compression.

Hardness: Hardness of golf ball layer is measured generally in accordance with ASTM D-2240, but measured on the land area of a curved surface of a molded ball. Other types of hardness, such as Shore C or JIS-C hardnesses may be provided as specified herein. For material hardness, it is measured in accordance with ASTM D-2240 (on a plaque).

Method of measuring COR: A golf ball for test is fired by an air cannon at an initial velocity of 131 ft/s, and a speed monitoring device is located over a distance of 0.6 to 0.9 meters from the cannon. When striking a steel plate positioned about 1.2 meters away from the air cannon, the golf ball rebounds through the speed-monitoring device. The return velocity divided by the initial velocity is the COR. A COR measuring system is available from ADC.

As shown in FIG. 1, golf ball 100 includes an inner core layer 110, an outer core layer 120, an inner cover layer 130, and an outer cover layer 140. Inner core layer 110, which may also be considered an inner core and which encompasses a center of golf ball 100, is generally made from a resin. Outer core 120 is generally made from rubber. Inner cover layer 130, sometimes considered to be a mantle layer, is generally made from a resin material. Outer cover layer 140 is generally made from a resin material. Outer cover layer 140 includes dimples. Outer cover layer 140 is coated by a single top coat.

Inner core layer 110 is made from a blend of highly neutralized polymer compositions, sometimes called highly neutralized acid polymers or highly neutralized acid polymer compositions, and fillers. Inner core layer 110 generally includes two highly neutralized polymer compositions with additives, fillers, and melt flow modifiers. Inner core layer 110 generally includes HPF resins such as HPF2000 and HPF AD1035, produced by E. I. DuPont de Nemours and Company.

In some embodiments, inner core layer 110 may have a high resilience. Such a high resilience may cause golf ball 100 to have increased carry and distance. In some embodiments, inner core layer 110 may have a coefficient of restitution (COR) value ranging from 0.775 to 0.89. In some embodiments, inner core layer 110 may have a COR value ranging from 0.795 to 0.88. In one embodiment, inner core layer 110 has a COR value of approximately 0.8, as measured within engineering and machine testing tolerances. The COR value of inner core layer 110 may be greater than the COR value of golf ball 100. In some embodiments, the COR value of inner core layer 110 may be 0.005 to 0.02 greater than the COR value of golf ball 100. In this embodiment, inner core layer 110 has a COR value of 0.8 so that the overall COR value of golf ball 100 may be dampened by the cover layers to a level of 0.785 or less. It is believed by the inventors that if an inner core layer 110 made from highly neutralized polymers has a higher COR than 0.8, then the resulting ball may be non-conforming. It is also believed that such an inner core having a higher COR than 0.8 may have undesirable sound properties. FIG. 2 shows the COR of inner core layer 110 of the exemplary embodiment at 131 ft/s, 140 ft/s, and 160 ft/s.

Inner core layer 110 has a diameter between about 20 mm and 28 mm, and in the exemplary embodiment has a diameter between about 24 mm and 25 mm. It is believed by the inventors that if the inner core diameter is less than about 20 mm, then the initial velocity off of the driver may be too low. It is also believed that if the inner core diameter is greater than about 28 mm, then the feel may be too hard and the ball may spin too much, thereby decreasing driver distance.

Inner core layer 110 has a density of less than 1.1 g/cm^3, and in the exemplary embodiment inner core layer 110 has a density of about 1.05 g/cm^3. It is believed by the inventors that if the density of inner core layer 110 is higher than about 1.1 g/cm^3, then the moment of inertia of the ball and the spin may be negatively impacted.

In some embodiments, inner core layer 110 may have a compression deformation value ranging from about 2.5 mm to about 5 mm. In some embodiments, inner core layer 110 may have a compression deformation value ranging from about 3.5 mm to about 5 mm, and in some embodiments from about 3.5 mm to about 4.1 mm. In one embodiment, inner core layer 110 has a compression deformation value of about 3.75, when measured with an initial load of 10 kg and a final load of 130 kg. It is believed by the inventors that a compression deformation value of less than 2 mm results in a ball that may lack durability, particularly with respect to delamination with the outer core layer, undesirable high pitched sound properties, an overly hard feel, and reduction of distance off the driver. The benefits of the inner core compression appear to be more pronounced when the inner core layer compression deformation is greater than 3.5 mm. It is also believed that a compression deformation value of greater than 5 mm results in a ball with too soft a feel, an undesirable amount of spin off of the mid-irons, and undesirable low pitched sound properties. The benefits of the inner core compression appear to be more pronounced when the inner core layer compression deformation is equal to or less than 4.1 mm.

Inner core layer 110 may have a surface Shore D hardness of from 40 to 60. In some embodiments, inner core layer 110 may have a Shore D cross-sectional hardness ranging from 40 to 60 at any single point on a cross-section obtained by cutting inner core layer 110 in half. In some embodiments, inner core layer 110 may have a Shore D cross-sectional hardness ranging from 45 to 55 at any single point on a cross-section obtained by cutting inner core layer 110 in half. In some embodiments, the difference in Shore D cross-sectional hardness at any two points on the same cross-section may be within ±6 Shore D units. In some embodiments, the difference in Shore D cross-sectional hardness at any two points on the same cross-section may be within ±3 Shore D units.

Inner core layer 110 may be made by any suitable process, but in the examples herein, inner core layer 110 is made by an injection molding process. During injection molding process, the temperature of the injection machine may be set within a range of about 190° C. to about 220° C. Generally, before the injection molding process, the at least two highly neutralized polymer compositions may be kept sealed in a moisture-resistant dryer capable of producing dry air. Drying conditions for the highly neutralized polymer composition may include 2 to 24 hours at a temperature below 50° C.

Suitable additives and fillers may include, for example, blowing and foaming agents, optical brighteners, coloring agents, fluorescent agents, whitening agents, UV absorbers, light stabilizers, defoaming agents, processing aids, mica, talc, nanofillers, antioxidants, stabilizers, softening agents, fragrance components, plasticizers, impact modifiers, acid copolymer wax, surfactants. Suitable fillers may also include inorganic fillers, such as zinc oxide, titanium dioxide, tin oxide, calcium oxide, magnesium oxide, barium sulfate, zinc sulfate, calcium carbonate, zinc carbonate, barium carbonate, mica, talc, clay, silica, lead silicate. Suitable fillers may also include high specific gravity metal powder fillers, such as tungsten powder and molybdenum powder. Suitable melt flow modifiers may include, for example, fatty acids and salts thereof, polyamides, polyesters, polyacrylates, polyurethanes, polyethers, polyureas, polyhydric alcohols, and combinations thereof.

Outer core layer 120 generally surrounds and encloses inner core layer 110. Outer core layer 120 in the exemplary embodiment comprises a thermoset rubber material. Outer core layer 120 in the exemplary embodiment has a thickness of at least 4.8 mm. In the exemplary embodiment, where inner core layer 110 is made of a highly neutralized polymer composition having a diameter ranging from 20-28 mm, if the thickness of outer core layer 120 is less than about 4.8 mm, it is believed by the inventors that the feel of the golf ball may be too hard and may produce too much spin. It is believed by the inventors that the beneficial performance and aesthetic characteristics are maximized when the thickness of outer core layer 120 ranges from 5.0 mm to 8 mm. In the exemplary embodiment, the diameter of the core (inner core layer 110 and outer core layer 120 together) ranges from about 34 mm to about 39 mm.

Outer core layer 120 is generally formed by crosslinking a polybutadiene rubber composition as described in U.S. patent application Ser. No. 12/827,360, entitled Golf Balls Including Crosslinked Thermoplastic Polyurethane, filed on Jun. 30, 2010, and applied for by Chien-Hsin Chou et al., the disclosure of which is hereby incorporated by reference in its entirety. Various additives may be added to the base rubber to form a compound. The additives may include a cross-linking agent and a filler. In some embodiments, the cross-linking agent may be zinc diacrylate, magnesium acrylate, zinc methacrylate, or magnesium methacrylate. In some embodiments, zinc diacrylate may provide advantageous resilience properties. The filler may be used to alter the density of the material. The filler may include zinc oxide, barium sulfate, calcium carbonate, or magnesium carbonate. In some embodiments, zinc oxide may be selected for its advantageous properties. Metal powder, such as tungsten, may alternatively be used as a filler to achieve a desired density. In some embodiments, the density of outer core layer 120 may be from about 1.05 g/cm^3 to about 1.45 g/cm^3. In some embodiments, the density of outer core layer 120 may be from about 1.05 g/cm^3 to about 1.35 g/cm^3.

In some embodiments, a polybutadiene synthesized with a rare earth element catalyst may be used to form outer core layer 120. Such a polybutadiene may provide excellent resilience performance of golf ball 100. Examples of rare earth element catalysts include lanthanum series rare earth element compound, organoaluminum compound, and almoxane and halogen containing compounds. Polybutadiene obtained by using lanthanum rare earth-based catalysts usually employs a combination of a lanthanum rare earth (atomic number of 57 to 71) compound, such as a neodymium compound.

In some embodiments, a polybutadiene rubber composition having at least from about 0.5 parts by weight to about 5 parts by weight of a halogenated organosulfur compound may be used to form outer core layer 120. In some embodiments, the polybutadiene rubber composition may include at least from about 1 part by weight to about 4 parts by weight of a halogenated organosulfur compound. The halogenated organosulfur compound may be selected from the group consisting of pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenol; pentabromothiophenol; 2-bromothiophenol; 3-bromothiophenol 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; and their zinc salts, the metal salts thereof and mixtures thereof.

Table 1 provides an example of materials used to make outer core layer 120, according to the exemplary embodiment. The amounts of the materials listed in Table 1 are shown in parts by weight (pbw). TAIPOL™ BR0150 is the trade name of a rubber produced by Taiwan Synthetic Rubber Corp.

TABLE 1

| Outer Core Rubber Composition | |
|---|---|
| Rubber compound: | B |
| TAIPOL ™ BR0150 | 100 |
| Zinc diacrylate | 29 |
| Zinc oxide | 9 |
| Barium sulfate | 11 |
| Peroxide | 1 |

Outer core layer 120 may be made by any suitable process. For example, in some embodiments, outer core layer 120 may be made by a compression molding process. The process of making the outer core layer may be selected based on a variety of factors. For example, the process of making the outer core layer may be selected based on the type of material used to make the outer core layer and/or the process used to make the other layers.

In some embodiments, outer core layer 120 may be made through a compression molding process including a vulcanization temperature ranging from 130° C. to 190° C. and a vulcanization time ranging from 5 to 20 minutes. In some embodiments, the vulcanization step may be divided into two stages: (1) the outer core layer material may be placed in an outer core layer-forming mold and subjected to an initial vulcanization so as to produce a pair of semi-vulcanized hemispherical cups and (2) a prefabricated inner core layer may be placed in one of the hemispherical cups and may be covered by the other hemispherical cup and vulcanization may be completed. In some embodiments, the surface of inner core layer 110 placed in the hemispherical cups may be roughened before the placement to increase adhesion between inner core layer 110 and outer core layer 120. In some embodiments, inner core surface may be pre-coated with an adhesive before placing inner core layer 110 in the hemispherical cups to enhance the durability of the golf ball and to enable a high rebound.

In some embodiments, outer core layer 120 may have a surface Shore D hardness of from 50 to 60, which may be higher than the surface hardness of inner core layer 110. In some embodiments, outer core layer 120 may have a surface Shore D hardness of from 45 to 55. In an exemplary embodiment, outer core layer has a Shore D hardness of at least 55. In the exemplary embodiment, where inner core layer 110 is made of a highly neutralized polymer with a hardness of Shore D 55 or less, it is believed that an outer core layer having a Shore D of less than 55 may result in a golf ball with an overly soft feel and too much spin on iron shots.

In some embodiments, outer core layer 120 may have a compression between 2.7 mm and 3.3 mm, when measured with an initial load of 10 kg and a final load of 130 kg. It is believed by the inventors that a compression deformation value of less than 2.7 mm results in a ball that may lack durability, particularly with respect to delamination between inner core layer 110 and outer core layer 120, have an undesirably hard feel, have undesirable high pitched sound properties, and have poor distance off the driver. It is also believed that a compression deformation value of greater than 3.3 mm may produce an undesirable amount of spin off of the mid-irons, short distance off the driver, and undesirable low pitched sound properties. In the exemplary embodiment, an outer core layer compression of at least 2.9 was found to be particularly advantageous for feel.

It is also advantageous to measure the compression of outer core layer 120 using different initial and final loads. For example, one test measures with an initial load of 0.5 kg and a final load of 30 kg. Another test measures with an initial load of 0.2 and a final load of 5 kg. While the ADC compression testing machine identified above can be programmed to perform these compression tests, these types of compression tests may also be performed on a testing machine available from EKTRON TEK Co., LTD.; Model name: EKTRON-2000 GBMD-CS. In some embodiments, the outer core layer compression may be between about 0.9 mm and 1.1 mm when measured with an initial load of 0.2 kg and a final load of 5 kg. In some embodiments, the outer core layer compression may be between about 1.5 mm and about 1.9 mm when measured with an initial load of 0.5 kg and a final load of 30 kg. It is believed by the inventors that when this compression is less than about 1.5 mm, control on the iron and approach shots is compromised and the feel while putting may be too hard. It is believed by the inventors that when this compression is greater than about 1.9 mm, the spin off the driver may be too high, resulting in loss of distance. The ratio of these different compression measurements (the measurements of outer core layer 120 with different initial loads and different final loads) also has a bearing on the performance of golf ball 100. For example, the outer layer compression when measured with an initial load of 10 kg and a final load of 130 kg may be considered a first outer layer compression; the outer layer compression when measured with an initial load of 0.2 kg and a final load of 5 kg may be considered a second outer layer compression; and the outer layer compression when measured with an initial load of 0.5 kg and a final load of 30 kg may be considered to be a third outer layer compression. In the exemplary embodiment, the ratio of the third outer layer compression to the first outer layer compression, hereinafter "third to first compression", ranges from about 0.45 to about 0.55. It is believed by the inventors that when the third to first compression is higher than this range that the ball may have too much spin off the driver, thereby reducing distance, and also that control with the short irons and wedge may be relatively poor. This condition is exacerbated if the third to first compression is greater than 1. It is also believed that when the third to first compression is lower than this range, the feel of the ball may be undesirably hard and the feel while putting may also be undesirable. This condition is exacerbated if the third to first compression is less than 0.3. In the exemplary embodiment, the ratio of the second outer layer compression to the first outer layer compression, hereinafter "second to first compression", ranges from about 0.3 to about 0.4. It is believed by the inventors that when the second to first compression is higher than this range that the ball may have too much spin off the driver, thereby reducing distance, and also that control with the short irons and wedge may be relatively poor. It is also believed that when the second to first compression is lower than this range, the feel of the ball may be undesirably hard and the feel while putting may also be undesirable.

The relationship between the compression of outer core layer 120 and the compression of inner core layer 110 is another useful performance guide. In the exemplary embodiment, inner core layer 110 is generally softer than outer core layer 120. In the exemplary embodiment, the difference between the inner core layer compression and the outer core layer compression ranges from −0.3 to 1.5. If this inner core to outer core compression differential is less than −0.3, then it is believed by the inventors that the ball spin and the launch angle may be too low, also that the benefit of having a dual core may be lost. If this inner core to outer core compression differential is greater than 1.5, it is believed by the inventors that the feel may be too hard and ball durability may be too low, particularly with respect to delamination between the inner resin core layer and the outer rubber core layer. A subrange of an inner core to outer core compression differential of 0.5 to 1.0 appears to maximize the beneficial performance characteristics. The sum of the inner core compression and the outer core compression in the exemplary embodiment ranges from about 6.0 to about 7.5. If the sum of these compressions is less than about 6.0, golf ball 100 may feel too hard. If the sum of these compressions is greater than about 7.5, then golf ball 100 may feel too soft, may have too much driver spin, and driver distance may be negatively impacted.

Outer core layer 120 also has a coefficient of restitution, measured by firing the completed core (inner core and outer core) from the testing cannon. FIG. 2 shows the measurements of the COR of outer core layer 120 of the exemplary embodiment with initial velocities of 131 ft/s, 140 ft/s, and 160 ft/s (listed as Design 1, discussed further below).

Inner cover layer 130, sometimes considered to be a mantle layer, generally surrounds and encloses outer core layer 120. Inner cover layer 130 is made of a thermoplastic material, discussed further below. In some embodiments, inner cover layer 130 has a Shore D hardness, as measured on the curved surface, ranging from about 60 to 80. In the exemplary embodiment, inner cover layer 130 is the hardest layer in golf ball 100, having a Shore D hardness of about 68, though a range of 64 to 69 produces a beneficial effect. An inner cover layer hardness of less than 64 may produce too much spin and greater than 69 may produce undesirable sound and feel properties.

In the exemplary embodiment, inner cover layer 130 has the highest density of any layer in golf ball 100. In the exemplary embodiment, inner cover layer 130 has a density ranging from about 1.10-about 1.17 g/cm^3. A high density for inner cover layer 130 improves the moment of inertia over commercially available high performance golf balls.

In some embodiments, outer cover layer 140 of golf ball 100 may have a Shore D hardness, as measured on the curved surface, ranging from 40 to 60. To have a low spin performance off the driver shot and good hitting feel, inner cover layer 130 may have a higher flexural modulus than outer cover layer 140. In some embodiments, inner cover layer 130 may have a flexural modulus ranging from 50,000 psi to 100,000 psi, or from 60,000 psi to 100,000 psi and outer cover layer 140 may have a flexural modulus ranging from 200 psi to 3,000 psi, or from 300 psi to 2,000 psi. In some embodiments, inner cover layer 130 may have a first flexural modulus and outer cover layer 140 may have a second flexural modulus, and a ratio of first flexural modulus to second flexural modulus (first flexural modulus/second flexural modulus) may range from 10 to 30. In some embodiments, ratio of first flexural modulus to second flexural modulus (first flexural modulus/second flexural modulus) may range from 25 to 100. In some embodiments, the ratio of first flexural modulus to second flexural modulus (first flexural modulus/second flexural modulus) may range from 95 to 250. In some embodiments, inner core layer 110 may have a third flexural modulus. In some embodiments, the ratio of first flexural modulus to third flexural modulus (first flexural modulus/third flexural modulus) may range from 5 to 10. Outer cover 140 having a lower flexural modulus than inner cover 130 and/or inner core layer 110 may provide golf ball 100 with a good feel in short shots and putting shots.

In the exemplary embodiment, inner cover layer 130 has an inner cover COR. FIG. 2 shows the inner cover COR for the exemplary embodiment (designated as Design 1).

In some embodiments, inner cover layer 130 and/or outer cover layer 140 may be made from a thermoplastic material including at least one of an ionomer resin, a highly neutralized polymer composition, a polyamide resin, a polyester resin, and a polyurethane resin. In some embodiments, inner cover layer 130 may include the same type of material as outer cover layer 140. In some embodiments, inner cover layer 130 may include a different type of material from outer cover layer 140.

Table 2 provides an example of materials used to make inner cover layer 130, according to the exemplary embodiment. The amounts of the materials listed in Table 2 are shown in parts by weight (pbw) or percentages by weight. Neothane 6303D is the trade name of a thermoplastic polyurethane produced by Dongsung Highchem Co. LTD.

TABLE 2

| Inner Cover Layer Material | |
|---|---|
| Resin: | C |
| Neothane 6303D | 100 |

In some embodiments, outer cover layer 140 of golf ball 100 may have a thickness ranging from 0.5 mm to 2 mm. For example, outer cover layer 140 may have a thickness of 1 mm. In some embodiments, outer cover layer 140 may have a thickness ranging from 1 mm to 1.5 mm. For example, in some embodiments, outer cover layer 140 may have a thickness of 1.2 mm.

Outer cover layer 140 may have a thickness T1, inner cover layer may have a thickness T2, and outer core layer 120 may have a thickness T3. In some embodiments, T1 may be greater than T2. In some embodiments, T1 and T3 may have the following relationship: $5T1 \leq T3 \leq 10T1$.

Table 3 provides an example of materials used to make outer cover layer 140, according to the exemplary embodiment.

TABLE 3

| Outer Cover Layer Material | |
|---|---|
| PTMEG (pbw) | 100 |
| BG (pbw) | 15 |
| TMPME (weight % to total components) | 10% |
| DCP (weight % to total components) | 0.5% |
| MDI (pbw) | 87.8 |
| (NCO index) | 1.01 |

The amounts of the materials listed in Table 3 are shown in parts by weight (pbw) or percentages by weight, as indicated. "PTMEG" is polytetramethylene ether glycol, having a number average molecular weight of 2,000, and is commercially available from Invista, under the trade name of Terathane® 2000. "BG" is 1,4-butanediol, commercially available from BASF and other suppliers. "TMPME" is trimethylolpropane monoallylether, commercially available from Perstorp Specialty Chemicals AB. "DCP" is dicumyl peroxide, commercially available from LaPorte Chemicals Ltd. "MDI" is diphenylmethane diisocyanate, commercially available from Huntsman, under the trade name of Suprasec® 1100. The material for outer cover layer 140 may be formed by mixing PTMEG, BG, TMPME, DCP and MDI in the proportions shown in Table 3. Specifically, these materials may be prepared by mixing the components in a high agitated stir for one minute, starting at a temperature of about 70° C., followed by a 10-hour post curing process at a temperature of about 100° C. The post cured polyurethane elastomers may be ground into small chips.

In some embodiments, the density of inner cover layer 130 or outer cover layer 140 may range from about 1.1 g/cm^3 to about 1.45 g/cm^3. In some embodiments, the density of inner cover layer 130 or outer cover layer 140 may range from about 1.1 g/cm^3 to about 1.35 g/cm^3. In some embodiments, the layers used to make golf ball 100 may have a specified relationship in terms of their respective physical properties. For example, to have greater moment of inertia, the golf ball layers may have a density gradient increased from inner core layer 110 to outer cover layer 140. In some embodiments, inner core layer 110 may have a first density, outer core layer 120 may have a second density greater than the first density by at least 0.01, and inner cover layer 130 may have a third density greater than the second density by at least 0.01. In some embodiments, golf ball 100 may have the following mathematical relationship for density of each layer: inner core layer 110 may have a density SG1; outer core layer 120 may have a density SG2; inner cover layer 130 may have a density SG3, and outer cover layer 140 may have a density SG4, wherein SG3>SG4>SG2>SG1. In the exemplary embodiment, the sum of SG3 and SG4 is at least 2.2. If this sum is less than 2.2, then the moment of inertia may be too low for maximized spin benefits.

In some embodiments, golf ball 100 may have a moment of inertia between about 80 g/cm^2 and about 90 g/cm^2. Such a moment of inertia may produce a desirable distance and trajectory, particularly when golf ball 100 is struck with a driver or driven against the wind.

In some embodiments, golf ball 100 may include a ball compression deformation of 2.2 mm to 4 mm. In some embodiments, golf ball 100 may have compression deformation of 2.5 mm to 3.5 mm. In some embodiments, golf ball 100 may have compression deformation of 2.5 mm to 3 mm.

Golf ball 100 as a whole also has a ball COR. FIG. 2 shows the ball COR of the exemplary embodiment at initial velocities of 131 ft/s, 140 ft/s, and 160 ft/s. In the exemplary embodiment, the ball COR remains under 0.8 to assure that the exemplary embodiment ball remains conforming with USGA rules.

The relationship of the coefficients of restitution of the various layers also provides information about the performance. To achieve various benefits of performance and feel as discussed above for the exemplary embodiment, the inner core layer COR is less than the outer core layer COR. In the exemplary embodiment, the inner core layer COR is about 0.8, while the outer core layer COR is greater than 0.8. The outer core layer COR is the highest in the exemplary embodiment. The outer core layer COR is greater than the inner cover layer COR. The inner cover layer COR is greater than the COR of the ball as a whole. The outer core layer COR is greater than the ball COR. The inner core layer COR is greater than the ball COR.

In some embodiments, golf ball 100 may have 300 to 400 dimples on the outer surface of outer cover layer 140. In some embodiments, golf ball 100 may have 310 to 390 dimples on the outer surface of outer cover layer 140. In some embodiments, golf ball 100 may have 320 to 380 dimples on the outer surface of outer cover layer 140. When the total number of the dimples is smaller than 300, the resulting golf ball may create a blown-up trajectory, which reduces flight distance. On the other hand, when the total number of the dimples is greater than 400, the trajectory of the resulting golf ball may be easy to drop, which reduces the flight distance.

In a particularly successful embodiment of a high performance golf ball according to the present design, referred to above as the exemplary embodiment and below as Design 1, in terms of durability, driver distance, iron and wedge spin, and aesthetically pleasing feel and sound, the details of Table 4 were included in the design. The inner core and outer core in Design 1 are adhered together with an adhesive.

TABLE 4

| Details of Design 1 | |
|---|---|
| Inner Core | HPF 2000<br>HPF AD1035<br>Additives/Fillers/Melt Flow Modifiers |
| Outer Core | Polybutadiene Rubber |
| Inner Cover | Urethane |
| Outer Cover | Thermoplastic Polyurethane |
| Coating | Paint |

Comparisons were made against other commercially available high performance golf balls. Table 5 shows a list of the comparison balls and their design details.

TABLE 5

| Comparison Balls | | | | |
|---|---|---|---|---|
| Ball ID | Inner Core Material | Outer Core Material | Inner Cover Material | Cover Material |
| Comp1 | PBR | PBR | Ionomer | Urethane |
| Comp2 | PBR | PBR | Ionomer | Urethane |
| Comp3 | PBR | Polymer | Ionomer | Urethane |

FIG. 2 shows the differences in structure and performance between Design 1 and Comp1, Comp2, and Comp3. The 0.5-30 kg and 0.2-5 kg compression tests were performed on a testing machine available from EKTRON TEK Co., LTD.; Model name: EKTRON-2000 GBMD-CS. As can be seen from the data in FIG. 2, Design 1 includes the advantageous inner core and outer core compressions, as discussed above.

Additional details of similar golf ball designs and/or materials for use in the design set forth herein can be found in the following co-pending applications, all of which are incorporated by reference in their entireties:

U.S. Patent Publication No. 2011/0130220 to Ichikawa et al.;

U.S. Patent Publication No. 2012/0004050 to Ichikawa et al.;

U.S. Patent Publication No. 2013/0029784, currently U.S. patent application Ser. No. 13/193,025, titled "Golf Ball Having A Resilient Material", filed on Jul. 28, 2011 to Ichikawa et al.;

U.S. Patent Publication No. 2012/0046128 to Liu;

U.S. Patent Publication No. 2013/0184102, currently U.S. patent application Ser. No. 13/552,309, titled "Golf Ball Including A Blend Of Highly Neutralized Acid Polymers And Method Of Manufacture", filed on Jul. 18, 2012 to Ishii et al.;

U.S. Patent Publication No. 2013/0190106, currently U.S. patent application Ser. No. 13/560,300, titled "Golf Ball Having Layers With Specified Moduli", filed on Jul. 27, 2012 to Ishii et al.;

U.S. Patent Publication No. 2013/0029788, currently U.S. patent application Ser. No. 13/194,064, titled "A Golf Ball Including a Blend of Highly Neutralized Acid Polymers and Method of Manufacture", filed on Jul. 29, 2011 to Ishii et al.;

U.S. Patent Publication No. 2013/0217517, currently U.S. patent application Ser. No. 13/587,693, titled "Golf Ball Having Outer Cover With Low Flexural Modulus", filed on Aug. 16, 2012 to Ichikawa et al.;

U.S. Patent Publication No. 2013/0210552, currently U.S. patent application Ser. No. 13/587,714, titled "Golf Ball Having High Initial Velocity", filed on Aug. 16, 2012 to Ishii et al.; and U.S. Patent Publication No. 2013/0244811, currently U.S. patent application Ser. No. 13/250,305, titled "Golf Ball Having Relationships Among The Densities Of Various Layers", filed on Sep. 30, 2011 to Ishii et al.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball comprising:

an inner core layer comprising a highly neutralized polymer;

the inner core layer having a first coefficient of restitution;

an outer core layer enclosing the inner core layer, wherein the outer core layer comprises polybutadiene rubber;

the outer core layer having a second coefficient of restitution;

the outer core layer having an outer core layer thickness of at least 4.8 mm;

the outer core layer having an outer core layer compression between 2.7 mm and 3.3 mm when measured with an initial load of 10 kg and a final load of 130 kg;

an inner cover layer enclosing the outer core layer;

the inner cover layer having a third coefficient of restitution; and an outer cover layer enclosing the inner cover layer, the outer cover layer comprising thermoplastic polyurethane, wherein the golf ball as a whole has a ball coefficient of restitution, wherein the second coefficient of restitution is greater than the first coefficient of restitution, wherein the second coefficient of restitution is greater than the third coefficient of restitution, and wherein the third coefficient of restitution is greater than the ball coefficient of restitution.

2. The golf ball of claim 1, wherein the inner core layer has an inner core layer diameter between 20 mm and 28 mm.

3. The golf ball of claim 1, wherein the inner core layer comprises a blend of two different highly neutralized polymers.

4. The golf ball of claim 1, wherein the inner core layer consists essentially of two different highly neutralized polymers and an additional material.

5. The golf ball of claim 4, wherein the additional material comprises at least one of a filler, an additive, and a melt flow modifier.

6. The golf ball of claim 1, wherein the inner core layer is adhered to the outer core layer with an adhesive.

7. The golf ball of claim 1, wherein the inner core layer has an inner core layer compression between 3.5 mm and 4.1 mm when measured with an initial load of 10 kg and a final load of 130 kg.

8. The golf ball of claim 1, wherein the inner core layer has an inner core layer diameter, wherein the inner core layer diameter and the outer core layer thickness together is a core diameter, and wherein the core diameter is between 34 mm and 39 mm.

9. The golf ball of claim 1, wherein the ball coefficient of restitution is 0.8 or less.

10. The golf ball of claim 1, wherein the inner cover layer is thermoplastic.

11. The golf ball of claim 10, wherein the inner cover layer is a urethane.

12. The golf ball of claim 10, wherein the inner cover layer is an ionomer resin.

13. The golf ball of claim 10, wherein the inner cover layer is selected from the group consisting of: a highly neutralized polymer composition, a polyamide resin, a polyester resin, and a polyurethane resin.

* * * * *